United States Patent [19]

Libman

[11] Patent Number: 4,528,713

[45] Date of Patent: Jul. 16, 1985

[54] BROOM CAP

[75] Inventor: Robert J. Libman, Champaign, Ill.

[73] Assignee: Libman Broom Company, Arcola, Ill.

[21] Appl. No.: 606,870

[22] Filed: May 3, 1984

[51] Int. Cl.[3] ..... A46B 9/12; A46B 17/04

[52] U.S. Cl. ..... 15/171; 15/145; 15/146

[58] Field of Search ..... 15/146, 171, 143 R, 15/147 R, 145

[56] References Cited

U.S. PATENT DOCUMENTS

| | | | |
|---|---|---|---|
| 1,425,560 | 8/1922 | Waters | 15/171 |
| 3,052,907 | 9/1962 | Kubick | 15/146 |
| 3,533,123 | 10/1970 | Brunello | 15/171 |

FOREIGN PATENT DOCUMENTS

| | | | |
|---|---|---|---|
| 1355656 | 2/1964 | France | 15/143 R |
| 806145 | 12/1958 | United Kingdom | 15/171 |

*Primary Examiner*—Peter Feldman

*Attorney, Agent, or Firm*—Marshall, O'Toole, Gerstein, Murray & Bicknell

[57] ABSTRACT

A broom cap of rigid polymeric material comprising a skirt portion adapted to cover the upper portion of a bundle of flexible filaments bound to a handle to shape, and facilitate maintaining the shape, of the bundle of filaments; a shoulder portion closing and joined to the upper end of the skirt portion; a collar portion, having walls extending upwardly from the shoulder portion, with a hole at the top for receiving the handle; and a plurality of vertically and radially positioned ribs extending inwardly from the collar portion walls and adapted to hold the cap stationary against vertical displacement and lateral swinging movement after it is inserted on the handle and the cap is positioned to cover the upper portion of the bundle of filaments.

10 Claims, 3 Drawing Figures

BROOM CAP

This invention relates to brooms. More particularly, this invention is concerned with an improved broom cap for producing an improved broom.

BACKGROUND OF THE INVENTION

Brooms are commercially available in a wide variety of sizes and shapes and of different constructions. However, more and more brooms for domestic use generally comprise a bundle of filaments tightly secured on one end of a handle with a broom cap positioned over the top of the filament bundle to give the broom an attractive appearance and to shape, and maintain the shape of, the filament bundle. See U.S. design Pat. Nos. 210,997 and 228,532. The broom cap is generally molded of a suitable solid polymeric material, such as rigid polypropylene.

One of the problems with a broom cap as just described is in properly centering or positioning the cap over the filament bundle during broom manufacture. Generally, the hole in the cap through which the handle extends lacks supporting surfaces so that the cap can become canted on the handle during positioning and when stapled to the handle. Additionally, during broom use the cap, even if initially positioned properly, can be pivoted out of alignment so the broom then lacks its original acceptable appearance. A need accordingly exists for an improved broom cap, and a broom using it, which can be firmly attached to the handle and not be dislodged from position.

SUMMARY OF THE INVENTION

According to the invention a broom cap of rigid polymeric material is provided comprising a skirt portion adapted to cover the upper portion of a bundle of flexible filaments bound to a handle to shape, and facilitate maintaining the shape, of the bundle of filaments; a shoulder portion closing and joined to the upper end of the skirt portion; a collar portion, having walls extending upwardly from the shoulder portion, with a hole at the top for receiving the handle; and a plurality of vertically and radially positioned ribs extending inwardly from the collar portion walls and adapted to hold the cap stationary against vertical displacement and lateral swinging movement after it is inserted on the handle and the cap is positioned to cover the upper portion of the bundle of filaments.

The ribs desirably terminate in vertical edges which are adapted to contact the handle.

When the handle is about 0.75 to 12.5 inches in diameter the hole in the cap will have a diameter the same size or only minutely larger. With such handles and holes of that size, usually about 8 to 14 ribs are suitable for properly supporting the cap. About 12 ribs are preferred for a hole about 1 inch in diameter which receives a 1 inch diameter handle. Regardless of the number of ribs, they generally will be about 0.75 to 1.5 inches long and about 0.03 to 0.12 inch thick.

Desirably, the collar portion has a top covering its upper end except for the hole, and the upper ends of the ribs are joined to the collar portion top.

According to a second aspect of the invention a broom is provided comprising a handle; a bundle of flexible filaments bound to one end of the handle; a broom cap of rigid polymeric material covering the upper portion of the bundle of filaments to shape and facilitate maintaining the shape of the bundle of filaments; the broom cap having a skirt portion, a shoulder portion closing and joined to the upper end of the skirt portion, and a collar portion, having walls extending upwardly from the shoulder portion, with a hole at the top through which the handle extends; and a plurality of vertical and radially positioned ribs extending inwardly from the collar portion walls and securing the cap stationary on the handle and against vertical displacement and lateral swinging movement during use of the broom.

DETAILED DESCRIPTION OF THE DRAWING

To the extent it is reasonable and practical, the same elements or parts which appear in the various views of the drawings will be identified by the same numbers.

Figure 1:
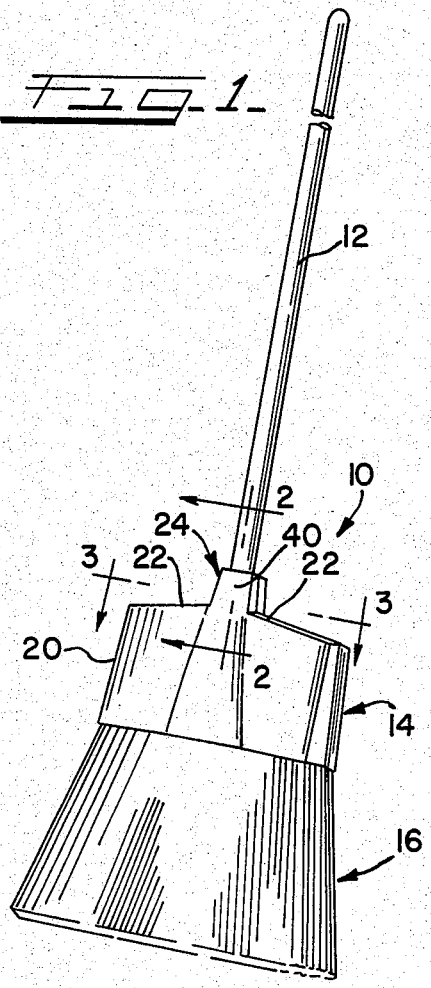
FIG. 1 is a perspective view of a broom showing one embodiment of broom cap according to the invention.
Figure 2:
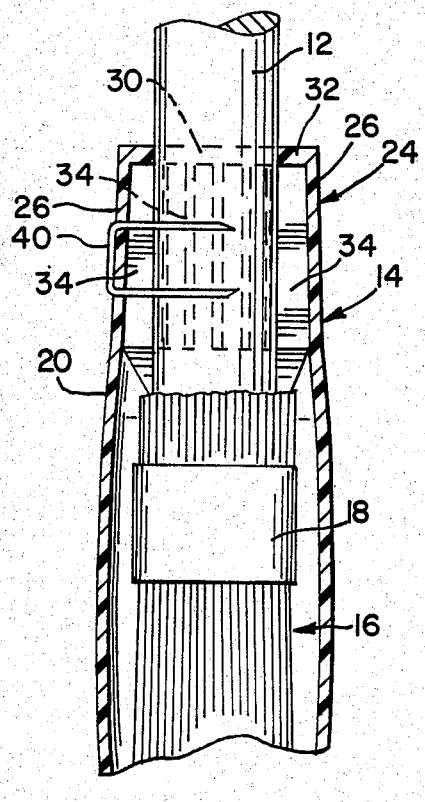
FIG. 2 is a sectional view taken along the line 2—2 of FIG. 1.
Figure 3:
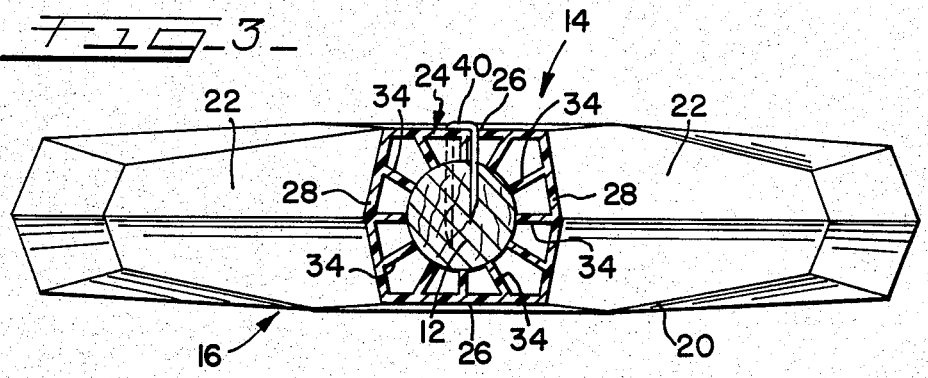
FIG. 3 is a sectional view taken along the line 3—3 of FIG. 1.

With reference to FIGS. 1 and 2, the broom 10 has a handle 12, extending through broom cap 14, and a bundle 16 of flexible filaments securely attached to the handle lower end by binding 18. As shown in the drawings, the bundle of filaments are bound together in a flat pattern thereby providing a broom much wider than it is thick.

The broom cap 14, which can be molded as an integral unitary item from rigid polypropylene, has a skirt portion 20 which is joined at the top to shoulder portion 22. Collar portion 24 has walls 26, 28 extending upwardly from the shoulder portion and a hole 30 in the top for receiving handle 12. The collar portion 24 has a top 32 covering the upper end except for hole 30.

A plurality of vertical radially located and spaced apart ribs 34 extend from the collar portion 24 walls 26, 28 inwardly into tight frictional engagement with handle 12. Although twelve ribs are shown since that number is particularly suitable for a one inch diameter handle, generally about eight to fourteen ribs can be suitably used. Furthermore, the ribs can be about 0.75 to 1.5 inches long and about 0.03 to 0.12 inch thick. Regardless of the size and number of ribs, they are desirably joined at their upper end to collar portion top 32.

A metal staple 40 can also be used to hold the cap in place. Staple 40 can extend through one side of collar portion 24 into wooden handle 12.

The ribs 34, in addition to firmly securing the cap on the handle, serve as guides when the cap is rapidly slid down the handle over the filament bundle during manufacture of the broom. The ribs yield enough to avoid scratching or marking a prepainted handle. Furthermore, since the ribs are hidden by the collar walls, the cap presents a smooth clean appearance.

The foregoing detailed description has been given for clearness of understanding only, and no unnecessary limitations should be understood therefrom, as modifications will be obvious to those skilled in the art.

What is claimed is:

1. A broom cap of rigid polymeric material comprising:

a skirt portion adapted to cover the upper portion of a bundle of flexible filaments bound to a handle to shape, and facilitate maintaining the shape, of the bundle of filaments;

a shoulder portion closing and joined to the upper end of the skirt portion;

a collar portion, having walls extending upwardly from the shoulder portion, with a hole at the top for slidably receiving the handle;

a plurality of vertically and radially positioned ribs extending inwardly from the collar portion walls;

the ribs terminating in vertical edges which are adapted to slidably contact the handle without scratching or marking the handle;

the collar portion having a top covering the upper end except for the hole and with the upper ends of the ribs being joined to the collar portion top; and the ribs being adapted to hold the cap against displacement and lateral swinging movement independent of the handle after it is inserted on the handle and the cap is positioned to cover the upper portion of the bundle of filaments with the handle extending completely through the cap.

2. A broom cap according to claim 1 in which there are about 8 to 14 ribs.

3. A broom cap according to claim 1 in which the hole is about 1 inch in diameter and there are about 12 ribs.

4. A broom cap according to claim 1 in which the ribs are about 0.75 to 1.5 inches long.

5. A broom cap according to claim 4 in which there are about 8 to 14 ribs.

6. A broom cap according to claim 4 in which the hole is about 1 inch in diameter and there are about 12 ribs.

7. A broom cap according to claim 4 in which the ribs are about 0.03 to 0.12 inch thick.

8. A broom comprising:

a handle;

a bundle of flexible filaments bound to one end of the handle;

a broom cap of rigid polymeric material having a skirt portion, a shoulder portion closing and joined to the upper end of the skirt portion, and a collar portion, having walls extending upwardly from the shoulder portion, with a hole at the top through which the handle extends;

the broom cap skirt covering the upper portion or the bundle of filaments to shape and facilitate maintaining the shape of the bundle of filaments;

a plurality of vertical and radially positioned ribs extending inwardly from the collar portion walls;

the ribs terminating in vertical edges which contact the handle without scratching or marking the handle when the cap is slidably installed on the handle;

the collar portion having a top covering the upper end thereof except for the hole and with the upper ends of the ribs being joined to the collar portion top; and the ribs securing the cap on the handle against displacement and lateral swinging movement independent of the handle during use of the broom.

9. A broom according to claim 8 in which there are about 8 to 14 ribs about 0.75 to 1.5 inches long.

10. A broom according to claim 8 in which there are 12 ribs and the hole is about 1 inch in diameter.

* * * * *

UNITED STATES PATENT AND TRADEMARK OFFICE

CERTIFICATE OF CORRECTION

PATENT NO. : 4,528,713

DATED : July 16, 1985

INVENTOR(S) : ROBERT J. LIBMAN

It is certified that error appears in the above-identified patent and that said Letters Patent is hereby corrected as shown below:

Column 1, line 52, change "12.5" to -- 1.25 --; column 4, line 16, change "or" to -- of --.

Signed and Sealed this

*Eighth* Day of *October 1985*

[SEAL]

*Attest:*

DONALD J. QUIGG

*Attesting Officer*

*Commissioner of Patents and Trademarks—Designate*